United States Patent [19]

Verhoeven

[11] 4,195,471

[45] Apr. 1, 1980

[54] PARKING METER

[76] Inventor: Marc L. R. M. Verhoeven, Hofstraat 29, 8440 Westende, Belgium

[21] Appl. No.: 903,547

[22] Filed: May 8, 1978

[30] Foreign Application Priority Data

May 6, 1977 [BE] Belgium ..... 177336

[51] Int. Cl.[2] ..... G07C 1/30; G07F 1/06

[52] U.S. Cl. ..... 368/90; 194/DIG. 22; 368/239

[58] Field of Search ..... 58/141–143; 194/1 R, 4 R–4 G, 9 T, DIG. 18, DIG. 22; 340/51; 116/114 T

[56] References Cited

U.S. PATENT DOCUMENTS

| | | | |
|---|---|---|---|
| 1,752,071 | 3/1930 | Doyle | 58/143 X |
| 3,153,469 | 10/1964 | McPherson | 194/4 F |
| 3,277,647 | 10/1966 | Bidet | 58/143 |
| 3,828,907 | 8/1974 | Bock | 194/DIG. 22 X |
| 3,998,307 | 12/1976 | Kolben et al. | 194/4 R |

*Primary Examiner*—Vit W. Miska

*Attorney, Agent, or Firm*—Thomas A. Briody; William J. Streeter; Bernard Franzblau

[57] ABSTRACT

Parking meter comprising a visible means, a first time measuring device which switches the visible means off after a given parking period and a second time measuring device which renders the visible means unusable after a predetermined parking time which is many times longer than the given parking period.

6 Claims, 6 Drawing Figures

PARKING METER

The invention relates to a parking meter intended to be mounted in a vehicle in a position which is visible from the outside, comprising at least visible means which indicates parking has been paid for, a control device, provided with manually operable switching means, for making the visible means operative at the beginning of the parking period and to adjust it into a rest condition at the end of the parking period.

Such a device is disclosed in French Pat. No. 1,210,610 and is intended to replace the current parking meters which are arranged near parking spaces to check the parking time and to collect the parking fees. The visible means consists of a lamp whose service life is used to measure a total parking time, possibly composed of several separate parking periods, the parking fees being collected by means of the sale of lamps which are suitable for this parking meter only.

It is an object of the invention to improve the utility of the parking meter defined in the preamble to a considerable extent.

The parking meter according to the invention is characterized in that the control device comprises a first time measuring device coupled to the first switching means for making the measuring device operative when the visible means are put into operation and for stopping the time measuring device when the visible means is adjusted to the rest condition, and in that the control device is provided with additional switching means which are connected to the time measuring device and coupled to the visible means for putting the visible means out of service after a predetermined working period of the time measuring device from an initial position, the time measuring device being reset to the initial position at the same time.

This has the advantage that parking periods which are smaller than the operating life of the visible means can be monitored. A further advantage is that the total parking time is independent of the operating life of the visible means and, consequently, independent of tolerances in this operating life, so that the collected parking fees correspond accurately to the used parking times.

In accordance with a further measure the parking meter is characterized in that the control device comprises a second time measuring device, coupled to the first switching means for making this second time measuring device operative when the visible means are put into operation and for resetting the second time measuring device to an initial position when the visible means are reset to the rest position, this time measuring device being coupled to the second switching means for adjusting the visible means to the rest position after a predetermined working period of the second time measuring device and for resetting the second time measuring device to the initial position, the predetermined working period of the second time measuring device being small relative to the predetermined working period of the first time measuring device.

This measure has the important advantage that parking periods which are shorter than the total parking time for which parking fees were paid when the visible means was purchased can be monitored.

The invention and its advantages will be further explained with reference to the embodiments shown in the Figures, wherein corresponding components have been given the same reference numerals.

Herein:

Figure 1:
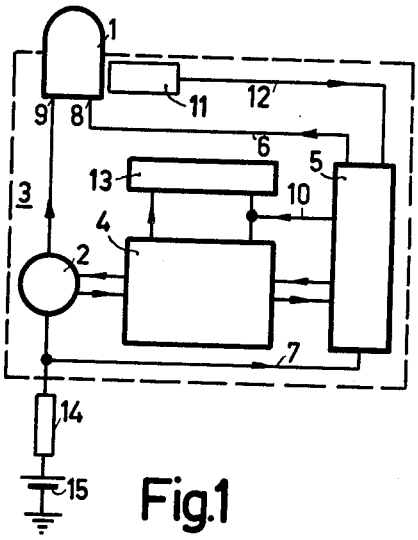
FIG. 1 shows a block diagram of an embodiment of the parking meter according to the invention.

The parking meter shown in FIG. 1 has a lamp 1 which is connected via manually operable switching means 2, disposed in a control device 3, and via a fuse 14 to a battery 15 of a vehicle, not shown in the drawing.

When parking of the vehicle starts, lamp 1 is ignited by means of the manually operable switching means 2. The fact that lamp 1 burns is an indication that parking is valid.

In order to facilitate ascertaining whether vehicles parked on a parking site are making an offence or not, the parking meters must be provided in a position which is well-visible from the outside, such as the dashboard, and lamp 1 must, in the ignited state, be so bright that it is still perfectly visible in sunlight at a few meters distance (for example 5 m). Any other optical device which satisfies the above-defined requirements may be used instead of a lamp.

When parking is terminated, the lamp 1 is switched-off by means of the manually controllable switching means 2.

To increase the range of uses, the control device 3 comprises a timer 4, connected to the manually controllable switching means 2, and further comprises switching means 5 connected to the time measuring device. The switching means 5 is coupled to the lamp 1 via a conductor 6.

When the lamp is switched on the timer 4 is also started by means of the manually operable switch 2. This timer 4 is stopped by means of the manually operable switching means 2 when lamp 1 is switched off so that timer 4 measures the period of time during which lamp 1 burns. In addition, the timer 4 is arranged so that subsequent operating periods of the lamp 1 are measured in the same manner and these operating times are added together.

If the total measured period of time exceeds a predetermined value, for example 20 hours, the timer 4 supplies a control signal to the additional switching means 5. In response to this control signal the switching means 5 apply a signal via conductor 6 to the lamp 1 for rendering lamp 1 unusable. The battery voltage is, for example, supplied to a connecting terminal 8 of the lamp 1 via conductor 7, the switching means 5 and conductor 6. The parking meter is arranged so that the filaments burn out when the battery voltage is supplied to connecting terminal 8, whereas the lamp burns in the normal manner when the battery voltage is supplied via connecting terminal 9.

The burnt-out lamp must be replaced by a new lamp before valid parking becomes possible again. The parking fees can be collected by means of the sale of the lamps.

Furthermore, the timer 4 comprises a display 13 which indicates the parking time still available before the lamp 1 is rendered unusable. Alternatively, it is, however, possible to indicate the time already used up by parking. The display 13 is reset to the zero position by the switching means 5 via conductor 10 if this switching means 5 applies a signal to lamp 1 via conductor 6. The switching means 5 simultaneously resets the timer 4 to the initial position.

Furthermore the control device 3 comprises a safety device 11 coupled to the switching means 5. This safety device 11 is arranged so that when a lamp 1 which is still fit for use is removed a signal is applied via conductor 12 to the switching means 5 which, in response thereto, renders the lamp 1 as yet unusable via conductor 6. Thus, it is impossible to commit a fraudulent act by removing a lamp which is still fit for use at the end of the predetermined maximum parking time and to insert a lamp which has already burnt-out.

The control device described so far may be of an electronic as well as an electro-mechanical implementation.

Figure 2:
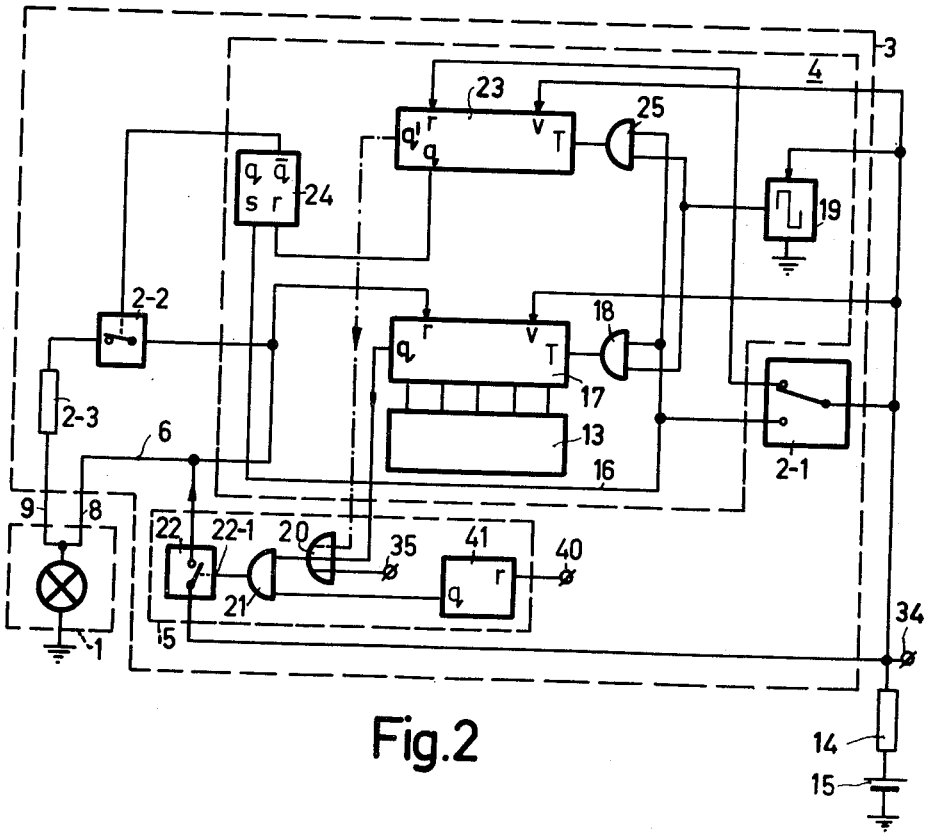
FIG. 2 shows a detailed embodiment of an electric implementation of the block diagram shown in FIG. 1.

The operation of the parking meter will now be described in detail with reference to an electronic embodiment shown in FIG. 2.

The manually controllable switching means 2 comprise a double-throw switch 2-1, a switch 2-2 and a resistor 2-3. When the parking meter is put into operation the double-throw switch 2-1 is moved manually from the rest position shown to the operating position, so that voltage from the battery 15 is supplied to the lamp 1 via the fuse 14, the double-throw switch 2-1, conductor 16, the switch 2-2 in the rest position shown and the resistor 2-3, causing the lamp 1 to ignite. The magnitude of the current through the lamp is determined by the resistor 2-3, by means of which a sufficiently long life of the lamp 1 is guaranteed.

The timer 4 comprises a first time measuring device 17 implemented as a counter 17 to which the pulses of a pulse generator 19 are applied via a normally non-conducting AND-gate circuit 18.

When the parking meter is put into operation by moving the switch 2-1 to the operating position a release voltage is supplied to the AND-gate 18 so that the pulse generator 19 supplies counting pulses to the counting input T of the counter 17. Each counting pulse increases the counting position of counter 17 by one. If, after a predetermined parking time, the parking meter is put out of operation by moving the switch 2-1 to the rest position the counting content of the counter 17 is not lost because the supply voltage supplied to input v of the counter 17 is not interrupted.

If the parking meter is switched on again at the beginning of a next parking procedure by means of switch 2-1 the counter 17 will start counting from the counting position then present in the counter. On attaining the maximum counting position a control signal is supplied to the additional switching means 5 via the output q of the counter 17. This control signal is applied via an OR-gate 20 and an AND-gate 21, which is normally in the conductive state, to a control terminal 22-1 of a switch 22. Switch 22 is closed under the control of this control signal so that the battery voltage is directly connected across the lamp 1. Because the operating voltage of the lamp 1 is smaller than the chosen battery voltage the filament of lamp 1 will immediately burn out, rendering the visible means permanently inoperative or unusable.

When switch 22 closes, a resetting signal is at the same time applied to a resetting input r of the counter 17 which resets the counter 17 to an initial position.

The counting position of counter 17 can be read by means of the display 13 so that it is possible to see at any moment how much of the total time available for each lamp has already been used up. By choosing the maximum counting position as the initial position of the counter 17 and by decreasing the counting position by one for each counting pulse supplied to the counting input T the display 13 can indicate the parking time still available. In that case the output Q must supply a control signal when the counter 17 arrives at the minimum counting position.

The first time measuring device ensures that the total time used for parking corresponds accurately to the parking time paid for by means of the selling price of the lamp.

In addition, the timer 4 comprises a second time measuring device implemented as counter 23 and a bistable element 24 having a differential setting input s connected to the make contact of the switch 2-1 and a resetting input r connected to a signal output $\bar{q}$ of the counter 23. The signal output q of the bistable element 24 is connected to a control input of the switch 2-2 so that when switch 2-1 is adjusted to the operating position the bistable element is set via the differential setting input s and the switch 2-2 is in the resting position shown in the drawing.

The counter 23 is connected to the pulse generator 19 via a normally cut-off AND-gate 25. When switch 2-1 is adjusted to the operating position the AND-gate 25 is made conductive and counting pulses of the counting pulse generator 19 are applied to the counting input T of the counter 23. The counting position of the counter 23 is increased by one by each counting pulse. On attaining a predetermined counting position the counter 23 supplies a resetting signal via signal output q to the resetting input r of the bistable element 24, causing this element to be reset. The inverse signal output $\bar{q}$ of bistable element 24 supplies in response thereto a control signal to the control input of switch 2-2, which control signal opens switch 2-2, causing the lamp to be extinguished.

By choosing the predetermined counting position of the counter 23 so that this position is attained after a parking period customary for present-day parking sites, for example two hours, it is possible to monitor these short parking periods independent of the total parking time paid for when a lamp is bought. The second time measuring device is reset by means of a resetting input r of counter 23 which is connected to the normally-closed contact of the switch 2-1.

The counter 23 is provided with a second signal output q' connected to an input of the OR-gate 20 of the further switching means (see the dashed-dotted line). The second signal output q' supplies an output signal for a counting position which is a fixed value higher relative to the counting position at which the output Q supplies an output signal. If, for the fixed value, a counting position is chosen which corresponds to, for example, 10 minutes, the lamp 1 will be made permanently unusable in the previously described manner 10 minutes after the lamp has extinguished, because the permitted parking period has elapsed. Thus it is possible to automatically fine motorists who considerably exceed the permitted parking period.

Figure 3:
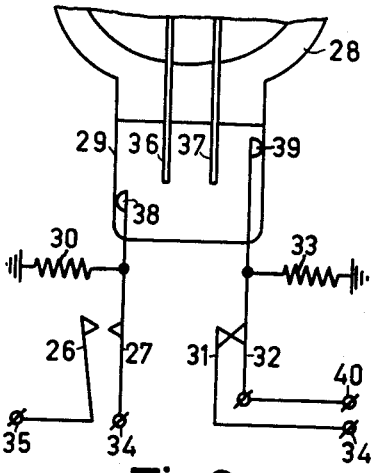
FIG. 3 shows an embodiment of a detail of a lamp base having spring-fitted contacts for use in the embodiment shown in FIG. 1.

FIG. 3 shows an electric embodiment of the safety circuit 11. This safety device comprises a first set of contacts 26 and 27 which are kept open by the sleeve 29 of the lamp 28 against the pressure of a spring 30, in case a lamp is present in the parking meter, and a second set of contacts 31 and 32 which are kept closed against the pressure of a spring 33 by the sleeve 29 of the lamp 28. Contact 27 is connected to terminal 34 (see FIG. 2) of the power supply, contact 26 is connected to an input 35 of the OR-gate 20 and the connecting pins 36 and 37 of the filament of the lamp do not go further than the supporting point 38 of contact 37 when the lamp is positioned on the parking meter. The socket, not shown, of the lamp is constructed so that the connecting pins are in an electric contact with the socket over the entire length. In this manner it is achieved that when the lamp is removed supporting point 38 is cleared first as a result of which the contacts 26 and 27 are closed at the moment the connecting pins 36 and 37 are still in contact with the socket. The battery voltage is then supplied via terminal 34 and the contacts 26 and 27 to the input 35 of OR-gate 20, which causes the filament of the lamp to burn-out in the previously described manner. Consequently, it is impossible to commit a fraud by replacing a still burning lamp by a lamp which has already burnt-out immediately prior to the lapse of the total parking time.

To prevent the safety device from being energized when a new lamp is put into place, contact 32 is extended to such an extent that supporting point 39 is positioned above the lower ends of the connecting terminals 36 and 37 when the lamp is fitted, contact 31 is connected to terminal 34 of the power supply and contact 32 is connected to a differential resetting input 40 of a monostable element 41, whose signal output q is connected to an input of the AND-gate 21.

Normally the monostable element is in the set state wherein the AND-gate 21 is not cut off.

When a new lamp is fitted, the contacts 31 and 32 will be closed before the connecting pins 36 and 37 make contact with the socket. This causes a signal transition at the differential resetting input of element 41 as a result of which the element 40 is reset and the AND-gate 21 is cut off, so that, when the pins 36 and 37 make contact with the socket, the signal applied via the contacts 26 and 27 are not passed by the AND-gate. After a short period of time which is amply sufficient to finish the fitting operation of the lamp, for example 3 seconds, the monostable element 41 returns to the set state and the safety circuit 11 is released owing to the fact that the AND-gate 21 becomes conductive. In this way the safety circuit 11 is prevented from rendering a new lamp unusable on insertion.

Figure 4:
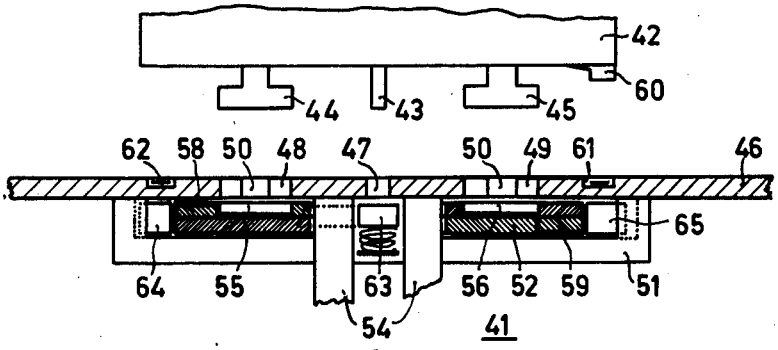
FIG. 4 shows a cross-section of a socket and a portion of a lamp base for a mechanical construction of the parking meter shown in FIG. 1.

FIG. 4 shows a cross-section of a mechanical implementation of a socket 41 and an associated lamp base of a parking meter according to the invention.

The lamp base 42 is provided with a centering pin 43 and two contact pins 44 and 45, these last two pins having a rectangularly widened end. The base 42 fits into an electrically non-conducting upper plate 46 of the parking meter, which plate is shown in further detail in FIG. 5. When fitting a lamp, the centering pin 43 is inserted into opening 47 and the contact pins 44 and 45 are passed through openings 48 and 49. These openings 48 and 49 are interconnected by means of a concentric, ring-shaped slot 50 around the opening 47. The width of the slot is equal to the cross-section of the non-widened portions of the contact pins 44 and 45. This enables rotation of the lamp around the centring pin 43 after the lamp has been positioned in the socket 41.

Figure 6:
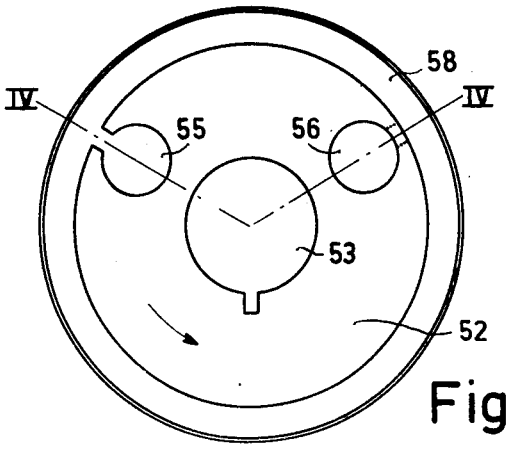
FIG. 6 shows another portion of the socket shown in FIG. 4.

It should be noted that the lamp can be inserted into the plate 46, or removed from it, in one position only. A circular cover 51 of an electrically non-conducting material is disposed concentrically with opening 47 against the bottom side of the plate 46. A circular, electrically non-conducting plate 52, called a rotary plate henceforth, is disposed in the space formed between the plate 46 and the cover 51. FIG. 6 shows an elevational view of this rotary plate 52. The rotary plate 52 has a central hole 53 which accommodates a shaft 54 around which the plate 52 is disposed in a rotatable manner. In addition, the rotary plate 52 is provided with blind drilling holes 55 and 56 the position of which corresponds to the holes 48 and 49 in a certain position A of the rotary plate 52 relative to the upper plate 46, called initial position henceforth. The depth of the blind holes 55 and 56 is equal to the length of the widened end portions of the contact pins 44 and 45 so that, after the lamp has been fitted, the widened end portions of the contact pins 44 and 45 just fill the blind holes 55 and 56.

To enable the supply of the required current to the contact pins 44 and 45 after the lamp has been fitted into the socket, the bottoms of the blind holes 55 and 56 are provided with conductive material. Ring-shaped conductors 58 and 59, which are mechanically connected to the conductive material on the bottoms of the holes 55 and 56, are applied to the bottom-side and the top-side of the rotary plate. The voltage required for energizing the lamp is supplied to the ring-shaped conductors 58 and 59 by means of sliding contacts, not further shown.

Furthermore, the lamp base 42 is provided with a stud 60 which, after fitting of the lamp, fits into a slot 61 provided in the plate 46. The bottom of the slot 61 is provided with conductive material 62 over the segment positioned between B and C. By means of the spring-fitted contact 63 it is possible to measure the presence of a lamp by a detector, not shown, provided between the metallic layer 62 and contact 63, via the measuring pin 43, the lamp base 42 and the stud 60. In situ of D the slot 61 is provided with a separate contact 64.

Figure 5:
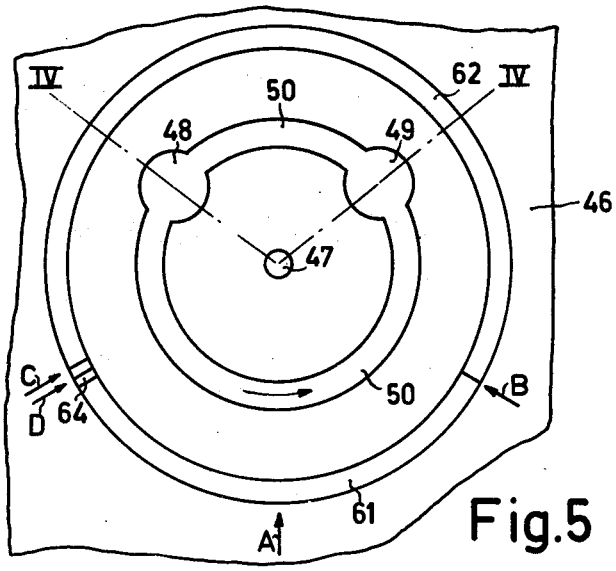
FIG. 5 shows a portion of the socket shown in FIG. 4.

The operation is as follows:

A new lamp is fitted in the initial position A (see FIG. 5). Thereafter the lamp is manually rotated into the direction indicated by the arrow over the arc A-B. In the position B switching on of the timer 4, for example a mechanical or electro-magnetic clock, is prepared by means of said detector. When the vehicle is parked the lamp 1 as well as the clock are started by means of the manually operable switching means 2. This clock drives, in a manner not shown, the rotary plate 52 in the direction indicated by the arrow. At the end of a parking period the clock is stopped and the lamp is extinguished by means of the manually operable switching means. As long as the predetermined total parking time has not yet been used up, stud 60 is in contact with the metallic layer 62. After said total parking time has been used up stud 60 comes into contact with contact 64 (position D of the rotary plate). This is measured by said detector and in response thereto the lamp is rendered unusable, by means of the further switching means 5, by burning-out the filament. The lamp can now be rotated manually over the arc D-A so that the rotary plate 52 returns to the initial position A and lamp 1 can be replaced.

To render it impossible that the lamp 1 is rotated in a direction opposite to the direction indicated by the arrow, wedges 64 and 65 have been disposed in hollow recesses in the circumference of the rotary plate 52 in the cover 51. The wedges clamp the rotary plate 52 if it is moved in the direction opposite to the direction indicated by the arrow.

The display 13 can be realized in a simple manner by marking the circumference of the lamp base in such a manner that a time scale is obtained and by applying a reference line on the plate 46, for example in situ of arrow A.

To increase the observable difference between a burning visible means, a visible means which is not burning and a visible means which has been rendered unusable, the lamp can be designed so that it has a different colour for each of the above-mentioned conditions. For example: white for a lamp which does not burn, blue for a lamp which does burn and black for a lamp which has been rendered unusable.

What is claimed is:

1. A parking meter adapted to be fitted in a vehicle in a position visible from outside the vehicle, comprising a visible means indicating parking has been paid for, a control device comprising manually operable first switching means for making the visible means operative at the beginning of a parking period and for adjusting it to a rest condition at the end of parking, said control device further comprising a first time measuring device coupled to the switching means for making the time measuring device operative when the visible means are put into operation and for stopping the time measuring device when the visible means is adjusted to the rest condition, the control device comprising further switching means connected to the time measuring device, and means coupling the further switching means to the visible means and to the time measuring device for rendering the visible means permanently inoperative after a predetermined operating period of the time measuring device starting from an initial position and for resetting the time measuring device to the initial position at the same time.

2. A parking meter as claimed in claim 1, characterized in that the control device comprises a second time measuring device coupled to said manually operable first switching means to make said second time measuring device operative when the visible means is put into operation and to reset the second time measuring device to an initial position when the visible means are adjusted to the rest condition means coupling, the second time measuring device to a second switching means for adjusting the visible means to the rest condition after a predetermined operating period of the second time measuring device, the predetermined operating period of the second time measuring device being smaller than the predetermined operating period of the first time measuring device.

3. A parking meter as claimed in claim 1 or 2, wherein the visible means comprises an incandescent lamp and the control device comprises means for rendering the incandescent lamp permanently inoperative by burning-out the lamp.

4. A parking meter as claimed in claim 3, wherein the incandescent lamp is provided with a special lamp base and in that the parking meter comprises a special lamp base socket which in conjunction with the lamp base locks the lamp until the lamp is rendered permanently inoperative.

5. A parking meter as claimed in claim 3, wherein the incandescent lamp is provided with a special lamp base and the parking meter comprises a special lamp base socket which in conjunction with the lamp base renders a still operative lamp permanently inoperative when the lamp is removed.

6. A parking meter as claimed in claim 1 or 2, wherein the visible means displays different colours to indicate whether the visible means is in operation, not in operation or has been rendered permanently inoperative.

* * * * *